United States Patent [19]

Laskowski et al.

[11] Patent Number: 4,620,373

[45] Date of Patent: Nov. 4, 1986

[54] DRY KILN AND METHOD

[76] Inventors: Donald R. Laskowski, 2346 Fisher Ave., Indianapolis, Ind. 46224; Daniel R. Tekulve, R.R. #3, Batesville, Ind. 46006

[21] Appl. No.: 633,712

[22] Filed: Jul. 23, 1984

[51] Int. Cl.[4] ..... F26B 5/04; F26B 13/30

[52] U.S. Cl. ..... 34/16.5; 34/92

[58] Field of Search ..... 34/1, 16.5, 92

[56] References Cited

U.S. PATENT DOCUMENTS

| | | | |
|---|---|---|---|
| 1,197,097 | 9/1916 | Banks | 34/9.5 |
| 1,333,848 | 3/1920 | Jacobs | 34/16.5 |
| 1,672,326 | 6/1928 | Kobiole | 34/16.5 |
| 1,778,079 | 10/1930 | Kristensson | 34/16.5 |
| 1,785,484 | 12/1930 | Kastner et al. | 34/1 |
| 2,296,546 | 9/1942 | Toney | 34/15 |
| 3,135,589 | 6/1964 | Stokes | 34/73 |
| 3,259,991 | 7/1966 | Illich, Jr. | 34/5 |
| 3,271,874 | 9/1966 | Oppenheimer | 34/5 |
| 3,434,222 | 3/1969 | Malmquist | 34/16.5 |
| 3,521,373 | 7/1970 | Pagnozzi | 34/16.5 |
| 3,721,013 | 3/1973 | Miller | 34/1 |
| 4,058,906 | 11/1977 | Pagnozzi | 34/16.5 |
| 4,127,946 | 12/1978 | Buchholz | 34/28 |
| 4,176,466 | 12/1979 | Pagnozzi et al. | 34/233 |
| 4,194,296 | 3/1980 | Pagnozzi et al. | 34/16.5 |
| 4,198,763 | 4/1980 | Kurihara | 34/16.5 |
| 4,445,025 | 4/1984 | Metz | 219/530 |
| 4,467,532 | 8/1984 | Drake | 34/16.5 |

FOREIGN PATENT DOCUMENTS 141727 1/1921 United Kingdom .

478341 2/1938 United Kingdom .

OTHER PUBLICATIONS

Rosen, Bodkin, and Gaddis, *Pressure Steam Drying of Lumber,* 33 Forest Products Journal 17, Jan. 1983.

Wood Drying News Digest, *Processes: Drying and Storage,* File: G-1.15, Jun. 1981.

Vacutherm, Inc. Technical Data and Letter, Nov. 16, 1983.

*Essiccazione Preservazione Movimentazione Del Legno,* I.S.V.E. (date unknown).

*Primary Examiner*—John J. Camby

*Attorney, Agent, or Firm*—Barnes & Thornburg

[57] ABSTRACT

A process and apparatus are disclosed for accelerating the drying of green and/or partially dried lumber. The lumber is dried at pressures below standard atmospheric pressure to rapidly remove moisture from the lumber without degrading the wood structure. A kiln for performing this function includes a chamber for a charge of lumber, an electrically activated flexible heating blanket to impart heat into the charge of lumber, a device for reducing pressure within the chamber, and a device for removing moisture vapor from the chamber. The process for accelerating the drying of the wood includes the step of heating the wood piece in the chamber to a selected temperature. The pressure in the chamber is reduced to a pressure at least as low as the vapor pressure of water at the selected temperature. The wood is controllably heated to maintain the wood at the selected temperature while the pressure in the chamber is reduced.

21 Claims, 7 Drawing Figures

DRY KILN AND METHOD

This invention relates to a process and apparatus for removing moisture from wood, and more particularly to a process and apparatus for accelerating the rate of drying wood.

Wood is usually dried in a kiln. Conventional kiln drying removes moisture from lumber by using heat and air flow to carefully reduce the moisture level in the wood without causing excessive degradation of the wood structure. This method, while energy cost-efficient in itself, is time-consuming and requires undesirably long drying times to dry wood sufficiently.

One of the more recent approaches to drying wood is disclosed in Rosen et al. U.S. Pat. No. 4,343,095. The Rosen process operates the kiln chamber at superatmospheric pressure, and is successful in accelerating drying time. This method, however, is often accompanied by excessive degradation of the lumber. Another process using superatmospheric pressure is disclosed in Jacobs U.S. Pat. No. 1,333,848.

Other recent approaches to drying lumber use a kiln at a subatmosphere pressure with a temperature in the kiln elevated beyond the boiling point of water for that given subatmospheric pressure. One such approach is described in "Processes: Drying and Storage," WOOD DRYING NEWS DIGEST, Forest Products Research Society, File: G-1.15 (date uncertain), wherein a process is described which utilizes reduced atmospheric pressure in conjunction with radio frequency heating. This process has successfully accelerated the drying of lumber while only minimally degrading the lumber. The use of radiowave energy, however, has its drawbacks. Initial equipment costs, power consumption costs, and variations in moisture content throughout the lumber charge at its final drying state caused by the current induced by the radio wave seeking a path of least resistance have limited the viability of this approach.

Another alternative method is discussed in Pagnozzi U.S. Pat. No. 3,521,373. The Pagnozzi method incorporates the use of alternating cycles of temperature elevation wherein the wood is heated at atmospheric pressure, followed by rapid evaporation of water at subatmospheric pressure. Pagnozzi's method reduces the drying time to some extent. However, high initial equipment costs limit reduction in drying time and relatively high operating costs limit the viability of this approach.

Pagnozzi utilizes relatively rigid heating plate elements with layers of wood inserted between the heating elements. By design, Pagnozzi's rigid heating plates rely upon convection (indirect contact) heat transfer to some extent. Convective heat transfer is inefficient in a vacuum. At the start of Pagnozzi's process, the heating plates are generally in contact with the surfaces of the wood. However, as the drying process continues, the wood shrinks and pulls away from Pagnozzi's rigid plates. This results in voids between the surface of the wood and the heating plates, across which heat must thereafter be transferred by convection. At reduced atmospheric pressures the relatively low density of air molecules is insufficient for effective transfer of heat across these voids from the plates to the wood.

Pagnozzi relies primarily upon the following principles of moisture movement to effect his drying of the wood: (1) water in wood moves from relatively wet areas to relatively dry areas; (2) water in wood moves from relatively warmer areas to relatively cooler areas; and (3) the boiling of water at subatmospheric pressures occurs on the wood surface, thereby creating a temperature gradient which draws water from the inside of the wood toward the outside surface, where evaporation takes place. Specifically, Pagnozzi relies upon rapid evaporation of water at the surface of the wood which is induced by the boiling of the water at subatmospheric pressures. During the subatmospheric evaporation period, Pagnozzi discontinues the application of heat, thus allowing the wood mass to cool off, and lengthing the amount of time necessary to dry the wood effectively.

Additionally, during the portion of Pagnozzi's heating cycle when heat is applied to the wood, air is allowed to enter Pagnozzi's chamber to increase the pressure within the chamber to approximately atmospheric pressure. Although the introduction of air into the chamber can facilitate the convective heating of the wood by heating plates, it suffers the disadvantage of requiring large amounts of energy to run a vacuum system to bring the chamber from atmospheric pressure to a substantially reduced pressure several times during the drying of the charge of wood.

One object of the instant invention is to provide a process and apparatus for drying wood which overcomes the above-mentioned problems.

In accordance with the instant invention, a process for accelerating the drying of wood comprises the following steps. A wood piece is heated in a drying chamber to a selected temperature. The pressure in the chamber is then reduced to a pressure generally at least as low as the vapor pressure of water at the selected temperature. Heat is controllably applied to the wood piece to maintain it at the selected temperature while the pressure is reduced in the chamber.

Additionally, in accordance with the instant invention, a heater of special design is provided for accelerating the drying of wood. The heater comprises a generally planar heating member which is placeable in contact with the surface of a wood piece, and which is sufficiently flexible to conform to, and remain in contact with, the surface of the wood piece during the drying of the wood piece.

Also in accordance with the instant invention, a housing is provided having a chamber in which a wood piece can be placed, with means for removing water vapor from the wood piece and for condensing the removed water vapor into liquid water.

One feature of the present invention is that flexible heating blankets are inserted between the wood layers. The heating blankets are preferably sufficiently flexible to conform to the surface of the wood during the drying process, and thereby to remain in direct contact with the wood throughout the drying cycle. This feature has the advantage of enabling the wood to be heated in the vacuum primarily by conduction, that is, by direct contact of the heating blanket with the surface of the wood. One or more heating blankets can be used inside the kiln, with a temperature control means being provided for each blanket. This arrangement permits the user to dry wood having differing moisture contents in the kiln simultaneously.

Another feature of the present invention is that it relies primarily upon water vapor movement within the wood to accelerate water removal therefrom. The instant invention utilizes reduced pressures, coupled with wood temperatures above the boiling point of water at the reduced pressures. This results in a vaporization process in the wood which occurs both within the cells and in the cell walls of the wood. By raising the temperature of the wood to a selected temperature and by reducing the pressure in the chamber to a point below the vapor pressure of water at that selected temperature, vaporization of the liquid water in the wood is fostered, establishing a pressure gradient between the interior of the wood and the surface areas of the wood. This promotes the migration of moisture toward the surface of the wood. Although the escape of moisture at the surface of the wood creates an evaporative temperature drop at the surface, heat is controllably applied to the surface of the wood to maintain the wood at the selected temperature. This controlled heating counteracts the temperature drop at the surface of the wood, in order to better take advantage of the fact that the rate of the evaporation of water is a function of the heat transfer. Since the vaporization of water requires the absorption of large quantities of heat (1,032 BTUs/lb. at 1.5 inches Hg absolute), the drying time of the wood is shortened by controllably applying heat to the surface.

It is also a feature of the instant invention to maintain reduced pressure in the chamber during most of the drying process. Although the pressure in the chamber is varied during the drying of the wood, the present invention does not require the release of the vacuum in the chamber to atmospheric pressure during any point in the drying cycle. Additionally, applicants have found that maintaining a reduced pressure in the chamber (and preferably a reduced pressure at or near the vapor pressure of water at the selected temperature to which the wood is heated), accellerates greatly the heat transfer from the heating blankets to the wood surface, and subsequently to the core of the wood. This feature has the advantage of reducing the total drying time while at the same time reducing the energy costs of the drying process. The evacuated chamber serves as a good insulator to insulate the heated wood from temperature loss to the atmosphere, thus reducing the amount of heat energy which must be supplied to the wood.

An additional feature of the instant invention is that a controlled means is provided in the chamber for condensing the water vapor which is removed from the wood into liquid water. Preferably, the condensing means is placed in thermally conductive contact with neither the wood nor with the walls of the chamber. This feature has the advantage of removing water from the air inside the kiln and placing it into a liquid form. As can be appreciated, the water removed from the wood could eventually reach the point of saturating the space within the chamber with water vapor, at which point, the drying process would come to a halt, or at least be slowed considerably. By cooling the water vapor and condensing it into liquid water, the water vapor pressure in the chamber is kept below the saturation point, thereby continuing the evaporation of water from the wood, and avoiding the condensation of water on the wood. The controlled condensing means for moisture removal also reduces degradation of the fiber structure of the wood.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which.

Figure 1:
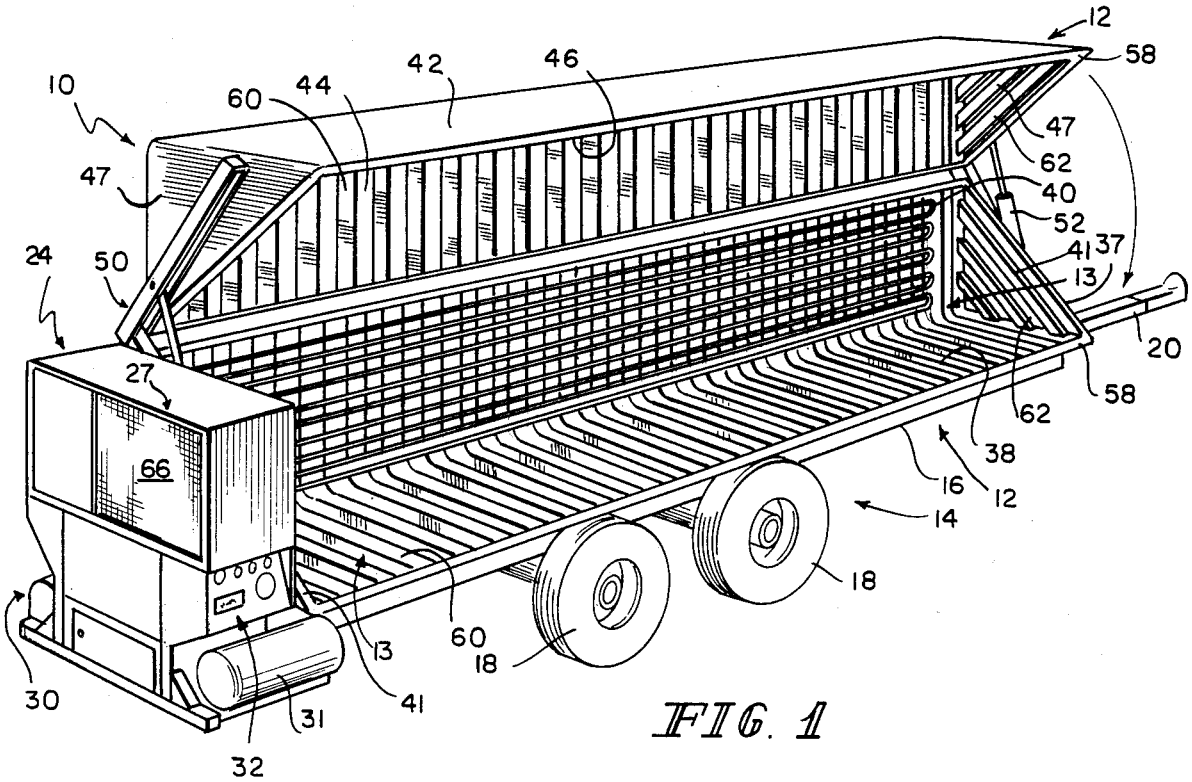
FIG. 1 is a perspective view of the kiln of the instant invention showing the kiln in its open position.

The portable kiln 10 shown in the figures includes a clamshell kiln housing 12, the interior of which defines a kiln chamber 13. Kiln housing 12 is mounted upon a trailer 14 having a generally planar bed portion 16 and a plurality of wheels 18. A hitching bar 20 is provided for enabling the trailer 14 to be connected to a towing vehicle (not shown) to enable the user to transport the kiln 10 to a job site. One or more adjustable support stands 22 may be coupled to the trailer 14 to enable the trailer 14 to rest in a horizontal position when the trailer 14 is disconnected from the towing vehicle. Kiln 10 includes a kiln control means 24 which is mounted to the bed portion 16 of the trailer for enabling the user to control the environment inside the chamber 13. The control means 24 includes a refrigeration system 27, an electrical heating system 29 (shown in FIG. 3), a vacuum system 30, and a hydraulic system 31. Control panel 32 is provided for enabling the user to control the refrigeration 20, heating 29, vacuum 30, and hydraulic 31 systems.

Figure 2:
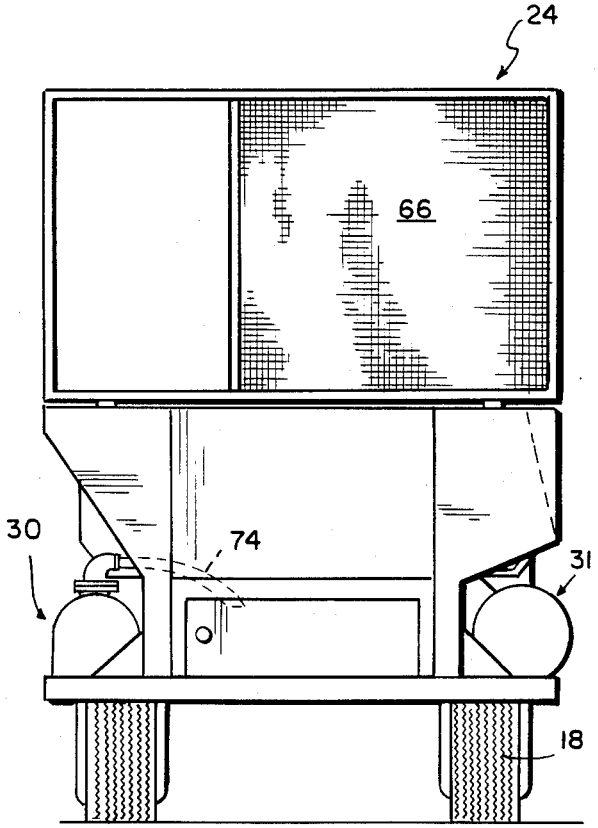
FIG. 2 is an end view of the kiln of the instant invention showing the kiln in its closed position.
Figure 4:
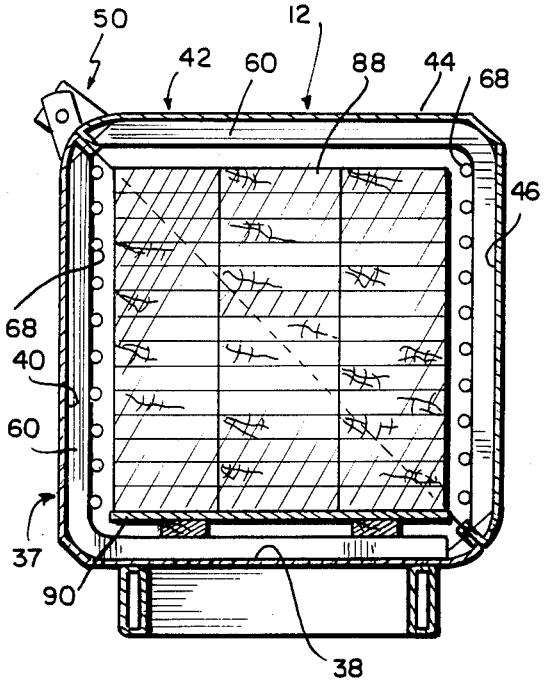
FIG. 4 is a transverse sectional view through the kiln, showing the kiln in its closed position.

The kiln housing 12 includes a right-triangular prism-shaped base portion 37 having a generally rectangular interior floor 38, a generally rectangular side wall 40, and a pair of opposed, right-triangular-shaped end walls 41. The right triangular prism shaped top portion 42 of the kiln housing 12 includes a generally rectangularly shaped ceiling 44 and side wall 46, and right triangularly shaped end walls 47. The top portion 42 is hingedly mounted to the base portion 37 by hinges 50. Hydraulic pistons 52 are coupled between the top portion 42 and base portion 37, and driven by the hydraulic pump 31 to move the top portion 42 between an open position, as shown in FIG. 1, and a closed position, as shown in FIGS. 2 and 4. As best shown in FIG. 4, when the top portion 42 is closed against base portion 37, the kiln housing 14 forms a housing having a rectangular cross section. The interior chamber 13 of the housing 14 has a corresponding rectangular cross section. The positioning of the hinge means 50 along the length of the kiln housing 12 to enable the top portion 42 to pivot about an axis generally parallel to the long axis of the kiln housing 12 provides a large opening to facilitate the placement of wood in the chamber 13 when the top portion 42 is open. A sealing gasket (not shown) can be placed along those edges 58 where the top portion 42 meets the base portion 37 to sealably engage the top portion 42 to the base portion 37 when the kiln housing 12 is closed.

A plurality of stiffening ribs 60 extend transversely to the long axis of the kiln housing 12 along the interior walls 38, 40, 44, 46 of the base portion 37 and top portion 42. Diagonally extending ribs 62 are also formed on the interior surfaces of the end walls 41, 47 of the base 37 and top portion 42. The ribs 60, 62 help rigidify the housing 12 to enable housing 12 to withstand the stress exerted on it by the reduction of pressure in the chamber 13 during the drying process. As can be appreciated by those skilled in the art, if the housing 12 were not made strong enough to withstand the stress imposed by the reduction of pressure in the chamber 13, the housing 12 could likely implode. It can also be appreciated that the structural parts of the kiln 10 are preferably made from a relatively strong material such as steel or aluminum to enable the kiln 10 to better withstand the stress imposed on it.

Referigeration system 27 includes a condenser 66 and a compressor (not shown) which are mounted to the trailer 14 exteriorly of the kiln housing 12. Refrigeration system 27 also includes a plurality of evaporator coils 68 which are placed in chamber 13. Preferably, the evaporator coils 68 are mounted to the interior side walls 40, 46, of the chamber 13 but are not placed in thermally conductive contact therewith. The evaporator coils 68 function as a condensing means for condensing water vapor in the chamber 13 into liquid water. As is known in the refrigeration system art, the evaporation of refrigerant inside the evaporator coils 68 absorbs heat from the environment outside the coils 68, thus cooling those areas in thermally conductive contact with the coils 68.

Vacuum system 30 includes a vacuum pump 72 having an intake (not shown) which opens into chamber 13 for drawing air from the chamber 13 and thereby reducing the pressure in the chamber 13. The pump 72 also includes an exhaust hose 74 (shown in FIG. 2) for exhausting air drawn by vacuum pump 72 to the atmosphere outside of chamber 13. The outlet of exhaust hose 74 is placed above a water tank 76, which provides a reservoir into which water drawn from the chamber 13 by vacuum pump 72 can be placed. Substantially all of the water drawn from chamber 13 by vacuum pump 72 will be that water which was condensed by the condensing means (evaporator coils 68) in the chamber 13.

Figure 3:
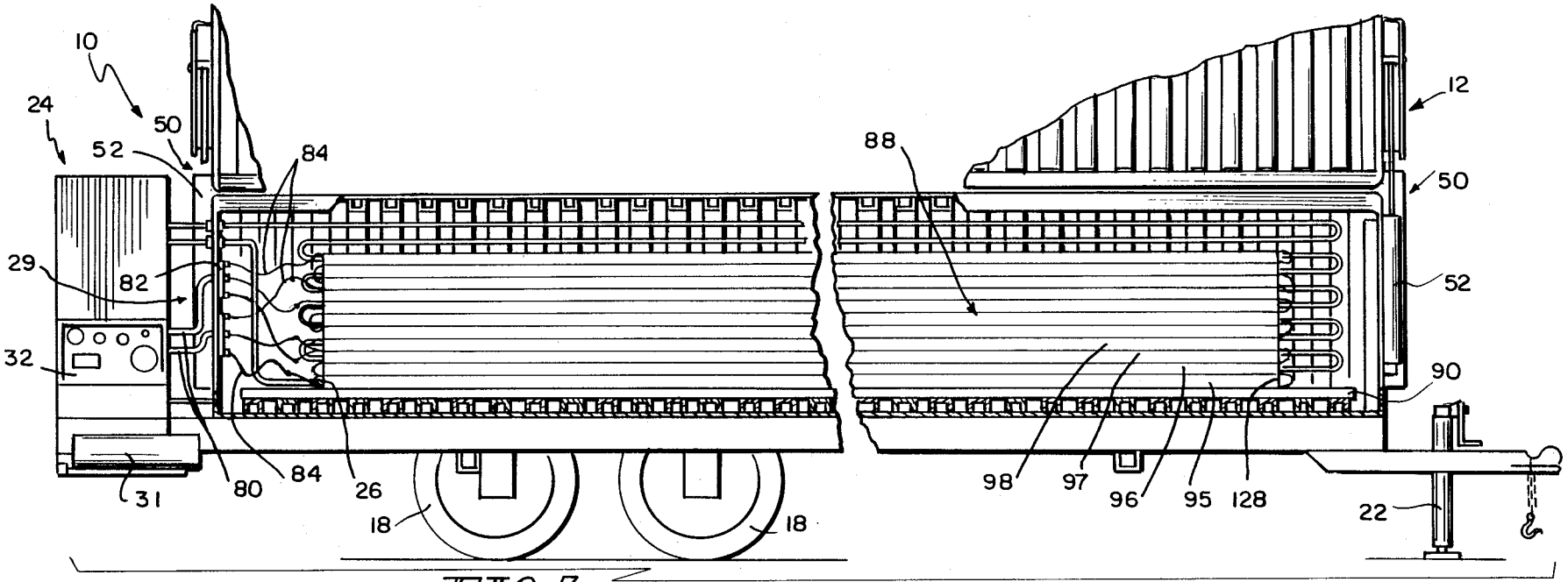
FIG. 3 is a side elevational view of the kiln, partially broken away, with a charge of wood loaded inside the kiln.
Figure 7:
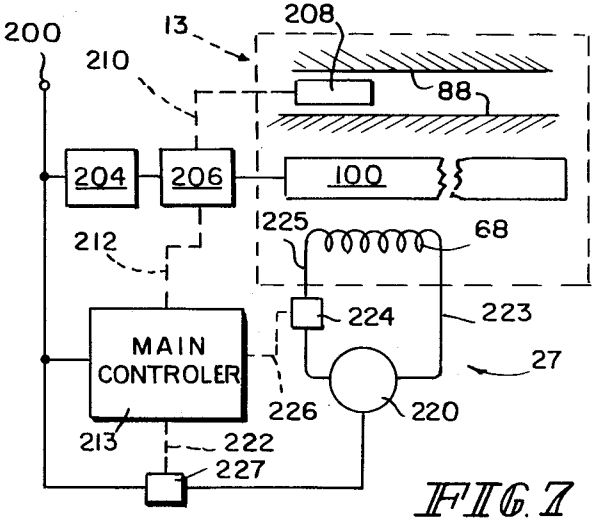
FIG. 7 is a schematic representation illustrating the controller of the present invention.

The electrical heating system 29 is best shown in FIG. 3 and includes an electrical source (not shown) which is coupled through control panel 32 to a plurality of trunk lines 80 which extend through the housing 12 to a plurality of terminal boards 82 mounted on an end wall 41 of base portion 37. A plurality of lead lines are electrically coupled to the terminal boards 82. As is shown in FIG. 7 and described in detail, infra, a separate transformer 204 and switch 206 are provided for each heating blanket 100. In one embodiment, the kiln 10 is provided with five transformers 204 to accommodate the individual control of five heating blankets 100.

A charge of wood 88 rests on a pallet 90, which rests on the the floor 38 of chamber 13. The pallet 90 maintains the charge of wood 88 in a spaced relation from the floor 38 side walls 40, 46, end walls 41, 47, and ceiling 44. Because the kiln housing 12 opens along its long side edge, the pallet 90 containing the charge of wood 88 can be moved easily into and out of the chamber 13 by a forklift (not shown) which can engage the underside of pallet 90, lift it vertically from the ground, or other surface, and move it laterally into the chamber 13.

Figure 5:
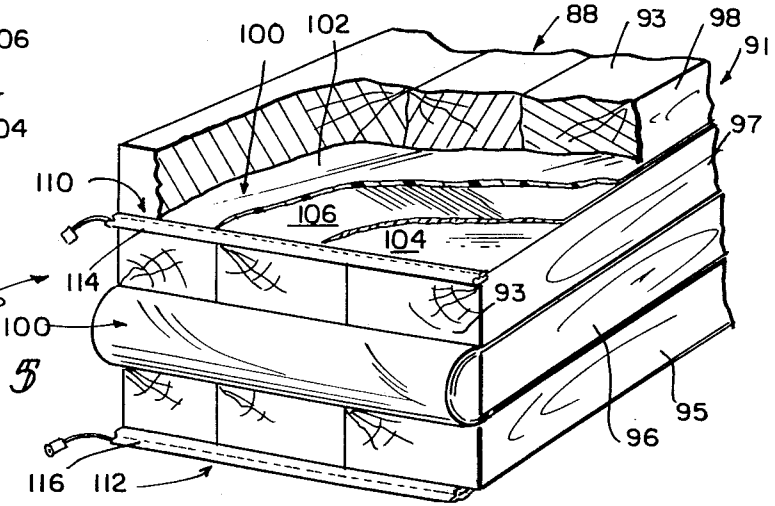
FIG. 5 is a persepective view, partly broken away, showing the arrangement of wood and heating means.

As best shown in FIGS. 3–5, the charge of wood 88 comprises a plurality of planks 93 which are placed in vertical stacks and horizontal layers. It will be appreciated by those skilled in the art that the kiln 12 can accommodate planks 93 having various sizes and configurations. The charge of wood 88 within the kiln chamber 13 is preferably subdivided into two or more bundles 91. As used herein, a "bundle" refers to that group of planks which are heated by a single individually controllable heating blanket 100. As will be described infra, the kiln can accomodate more than one heating blanket 100, and the charge of wood 88 can comprise more than one bundle 91.

Referring now to FIG. 5, a bundle of wood 91 is shown as having a first bottom layer 95 of planks 93, a second layer 96 of planks 93 stacked on top of the first layer, a third layer 97 stacked on top of the second layer 96, and a fourth layer 98 stacked on top of the third layer 97. A temperature sensing device, such as a thermocouple 208 (shown in FIG. 7) or thermister, is placed in the middle of the bundle of wood 91 to sense the temperature of the wood in that bundle 91. The operation of the temperature-sensing device 208 will be described infra. In a preferred embodiment, one temperature-sensing device 208 is employed for each heating blanket 100 used in the kiln chamber 13 at any given time.

The heating means used is preferably a flexible heating means such as heating blanket 100. Heating blanket 100 is interposed in a serpentine fashion between the layers 95, 96, 97, 98 of the charge of wood 88. The heating blanket 100 includes a first, top sheet 102 which is preferably made of a flexible, planar plastic sheet material which is form stable over the temperature range used in the drying process. The sheet material can have a thickness of 0.005 inches (0.127 mm). The top sheet 102 is placed in contact with the bottom surface of the planks 93 of the top layer 98. A second, bottom planar sheet of plastic 104 is disposed parallel to top sheet 102, and placed in contact with the upper surface of the planks of the third layer 97. The bottom sheet 104 has a size, shape, and composition similar to top sheet 102. A flexible, resistively heatable planar heating element 106 is interposed between the top and bottom layers 102 and 104.

The heating element 106 is preferably formed of a metal foil material, such as an aluminum foil having a thickness of 0.0009 inches (0.0229 mm). Preferably, the heating element 106 is sized to have a length approximately equal to that of the top and bottom plastic sheets 102, 104, but to have a width slightly less than that of the top and bottom sheets 102, 104. The top and bottom plastic sheets 102, 104, and flexible heating element 106, are formed into a flexible heating blanket 100 by laminating the three together into one common blanket.

Figure 6:
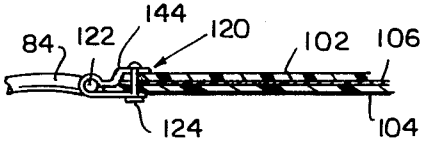
FIG. 6 is a sectional view showing the electrical terminal for the heating means.

The top sheet 102, bottom sheet 104, and heating element 106 are joined at their ends 110, 112 by terminals such as clamps 114. As best shown in FIG. 6, clamps 114 include an open receiving end 120 for receiving the top and bottom plastic sheets 102 and heating element 106, and a closed, outwardly projecting lip 122 to which is electrically coupled an electrical lead wire 84. The clamp 114 preferably extends along the entire width of the heating blanket 100. For instance, a plurality of rivets 124 can extend through the open receiving ends of the clamp 114, plastic sheets 102, 104, and heating element 106. The rivets 124 attach securely the clamp 114 to the sheets 102, 104 and element 106, and place the electrical heating element 106 in electrically conductive contact with the clamp 114.

The sheet members 102, 104 and resistive heating element 106 are made sufficiently flexible to conform to the surface of the wood planks 93 during the drying process. During the drying process, the planks 93 will normally shrink due to the removal of moisture therefrom. If a rigid heating member were used in place of flexible heating blanket 100, the surfaces of the planks 93 would pull away from the heater, leaving gaps between the heater and the wood planks 93. In the substantially evacuated environment of chamber 13 during the drying process, the gaps left between such a rigid heater and the planks would retard the heating of the planks. The heat from such a rigid heating plate would be transferred inefficiently across the gaps due to the lack of air molecules for transferring the heat from the rigid heating element to the planks 93. The flexible heating blanket 100 of the instant invention obviates this problem by conforming to the surface of the plank during the drying process to remain in direct contact with the surfaces of the planks 93 during the entire drying process. By this arrangement, the heating blanket 100 can heat the surfaces of the planks 93 by direct conduction, rather than indirect convection. An additional feature of the flexible heating blankets 100 is that they can be made to be relatively thin, thus enabling the user to stack more layers of wood in a kiln chamber of a given size, when compared to some known prior art heating devices.

The heating blanket 100 has a sufficient length to form a bundle 91 having one or more layers 95, 96, 97, 98. To form a bundle 91, an end 116 of the blanket 100 is placed adjacent the first end 126 of pallet 90, and the blanket is extended over the upper surface of pallet 90 to the opposite end 128 of pallet 90. The first layer of wood 95 is then placed over the heating blanket 100 so that a portion of heating blanket 100 is between the pallet and the bottom surface of the planks 93 of the first layer 95. The heating blanket 100 is then doubled over around the second end 128 of the first layer 95 and placed in contact with the upper surface of the planks 93 of first layer 95. The second layer 96 of planks 93 is then placed on top of the heating blanket 100. The heating blanket 100 is doubled over the first end 126 of second layer 96 and placed over the upper surface of second layer 96. The blanket 100 is extended over the top surface of layer 96 to end 128, and the third layer 97 is placed on top of the blanket 100 over second layer 96. The blanket is then doubled over around the second end 128 of layer 97, and extended over the top surface of third layer 97. Through this arrangement, the terminal end 114 of the blanket is adjacent the same end 126 of the bundle 91 as the first end 116. A similar blanket (not shown) can then be placed over the top surface of fourth layer 98 and around subsequent layers to form a second bundle.

Plank 93 and blanket 100 stacking arrangements other than that described above can also be used. It has been found by applicants that when thin planks of wood are being dried, (e.g., ½ inch (1.27 cm) thick or ⅝ inch (1.59 cm) thick planks), satisfactory drying will be achieved by placing two layers of planks in direct contact and by placing the blanket 100 in contact with the lower surface of the lower layer of planks and the upper surface of the upper layer of planks. In building such a bundle, the blanket 100 is placed between every other layer of planks, rather than between each layer as shown in FIG. 5.

Alternatively, when thicker planks, (e.g., 3 inches (7.62 cm) thick planks), are being dried, applicants have found it advantageous to place two layers of the same blanket between each layer of planks. In such a arrangement, the blanket 100 is placed in contact with the bottom surface of the first layer of planks, doubled over the end of the first layer, and placed in contact with the top surface of the first layer of planks. The blanket 100 is then doubled over itself and placed adjacent to the portion of the blanket 100 in contact with the top surface of the first layer of planks. The second layer of planks is then placed in contact with this portion of the blanket 100.

In any of the above described stacking and blanket arrangements, a plurality of bundles can be added on top of layer 98 to build a charge of wood 88 having a desired height. The charge of wood 88 can be built in this manner on a pallet 90 outside the trailer, and then lifted with a forklift into chamber 13. When the charge of wood 88 is inside the chamber, the terminals 114, 116 can be connected to their respective lead wires 84.

In many applications, several individually controllable heating blankets 100 will be used within the kiln chamber 13 during any given drying process. It has been found by applicants that generally wood having the same initial moisture content dries at the same rate. Likewise, wood having differing moisture contents dries at different rates. Applicants have found that placing planks 93 having different initial moisture contents within the same blanket 100 (and hence within the same bundle 91), results in the bundle 91 developing hot and cold spots. This can result in an unsatisfactory drying of the wood. However, applicants have also found that if all of those planks 93 placed within the same bundle have the same initial moisture content, satisfactory results will be achieved. Thus, multiple heating blankets can be used to dry multiple bundles of wood during any one given drying cycle period. Preferably, each of the heating blankets 100 is individually controlled, as will be described infra. Thus, if five individually controllable heating blankets 100 are used in the kiln chamber 13 during a drying process, planks 93 having five different initial moisture contents can be dried simultaneously, with each individually controllable blanket 100 being used to heat planks 93 having the same initial moisture content.

A schematic representation is shown in FIG. 7 which illustrates the controller of the present invention. The control means 24 includes a power source 200 which supplies power to a transformer 204, which, through switch and circuitry 206, supply power to heating blanket 100. As discussed above, the preferred embodiment of the present invention utilizes five transformers 204 to enable the kiln 10 to accommodate five independently controllable heating blankets 100 to individually controllably heat five bundles 91 of wood. A thermister or thermocouple 208 is placed in the middle of each bundle 91 of wood and is used for sensing the temperature of the wood. A communication line 210 connects the thermister or thermocouple 208 to the switch and circuitry 206. During the drying process, the heating blankets 100 are set to maintain the wood in the bundle 91 at a preselected temperature. The communication between the termister or thermocouple 208 and the switch and circuitry 206 turns the heating blanket 100 on and off during the drying cycle to maintain this preselected temperature. It has been found by applicants that during the initial phase of the drying process, the blanket will normally be turned on continuously to supply heat energy to the wood. For instance, the blanket 100 will supply heat continuously between a point wherein the wood has approximately a 70% moisture content and the point wherein the wood has approximately a 30% moisture content. As the wood reaches a moisture content of less than 30% or so, power is supplied to the heating blanket 100 on a relatively more intermittent basis. The power is supplied to the blankets on a less frequent basis as the wood becomes drier to prevent the wood from becoming too hot. The relative lack of moisture in the wood as the wood becomes drier slows the removal of heat from the wood. Hence, a given amount of heat causes the temperature of dry wood to increase more than the same amount of heat causes the temperature of moist wood to increase.

A communication line 212 is provided between the switch and circuitry 206 and the main controller 213. The communication line 212 can be used by the controller to process information regarding the operation of the switch and the circuitry 206, and hence heating blanket 100. The communication line 212 is also used to send signals to the switch and circuitry 206, and hence heating blanket 100, to turn on or turn off.

Additionally, the main controller 213 controls the operation of the refrigeration system 27. The refrigeration system 27 includes a refrigerant line 223 which directs refrigerant from the compressor 220 into the evaporator coils 68 disposed inside the kiln chamber 13, and a refrigerant line 225 which delivers refrigerant from the evaporator coils 68 to the compressor 220. A switch 227 is provided which is in communication with main controller 213 via a communication line 222 for controlling the operation of the refrigeration system 27.

A compressor pressure-sensor 224 is placed in refrigerant line 225 to sense the pressure at which the compressor 220 is operating. It has been found by applicants that as the wood approaches its end drying point, (e.g., 5 to 10% moisture content), the pressure at which the compressor 220 is operating will decrease substantially. This is due in part to the fact that as the wood reaches a point wherein it contains less moisture, less moisture can be driven from the wood by the drying process. As less moisture is being driven from the wood, there is less moisture which is contacting the evaporator coils 68, and hence imparting heat to the refrigerant inside the coils 68. Applicants have found that there is a correlation between the compressor pressure and the dryness of the wood. This correlation is utilized to indicate the point at which the kiln drying operation should be stopped. A communication line 226 is provided between the main controller 213 and the compressor sensor 224. The compressor pressure sensor 224 sends signals to the main controller 213 through the communication line 226. When the main controller 213 interprets the signal sent by the compressor pressure sensor 224 to be that pressure indicative of a condition wherein the wood is substantially dried to its finished point, the main controller 213 sends a signal through communication line at 222 to shut down the refrigeration system 27. Additionally, the main controller 213 can send a signal through communication line 212 to switch and circuitry 206 to shut the blankets 100 down, thus shutting off the electrical heating system 29.

The process of the present invention for utilizing the kiln 10 to dry the wood will now be explained. The process of the present invention provides a means for accelerating the drying of lumber at subatmospheric pressures. The present process enables a user to dry green and/or partially dried wood rapidly at a lower cost, with less structural degradation of the wood than the prior art wood-drying processes.

The following principles relating to the hydrological, cellular, and structural properties of wood are recognized and believed to be utilized in the process of the present invention: (1) The cellulose structure of wood seems to be of a sufficiently loose arrangement that changes in the pressure appear to be felt generally evenly throughout the thickness of any given plank of lumber. (2) A partially evacuated chamber is an excellent insulator of heat. (3) Water, when exposed to temperatures above its boiling point, will expand rapidly, or create pressure in the attempt to expand. This expansion or pressure will increase as the temperature of the water above its boiling point increases. (4) The boiling point of water varies according to the pressure of the chamber in which the water is placed. As the pressure decreases, the boiling point of the water is lowered. Water at a given temperature will boil when the pressure of the chamber in which the water is placed equals, or is less than, the vapor pressure of water at that temperature. A chart relating the vapor pressure of water to temperature of water is provided in the HANDBOOK OF CHEMISTRY AND PHYSICS, 50th Edition, Chemical Rubber Company, Cleveland, Ohio 1969, at page D-137. For example, water in a chamber at one standard atmosphere (760 mm Hg) of pressure will boil at 100° C. Similarly, water in a chamber having a pressure of 0.075 atmosphere (55.3 mm Hg) will boil at 40° C. (5) Water absorbs heat when it converts from its liquid state to its vaporous state, and releases heat when it converts from its vaporous state to its liquid state. The heat absorbed or released by water is rather large, being approximately 1,032 BTU/pound at 1.5 inches Hg absolute (573.33 calories per gram). (6) There is less intermolecular attraction between molecules of vaporous water than molecules of liquid water. Water, in its vaporous state usually occurs as a single molecule, unattached to other molecules, and having a diameter of less than 1 angstrom ($1\times10^{-8}$ cm). In its vaporous form, water vapor can migrate rather easily through the comparatively porous cellulose structure of wood. (7) Water vapor in wood moves from areas of the wood having increased pressures to areas of the wood having decreased pressures. (8) When wood having moisture therein at a given temperature is placed in a chamber having a pressure less than the vapor pressure of water at the given temperature, the removal of the water from the wood is suspected to be, primarily by vapor movement.

The above-mentioned principles are utilized to effect a quick and rapid drying of the wood with minimum degradation. After the charge of wood 88 is loaded into the chamber 13 as described, supra, the vacuum pump 72 is activated to reduce the pressure in the chamber. Power is then controllably applied to the heating blanket 100 to achieve a preselected temperature. When the average temperature of the wood charge reaches the selected temperature, the pressure within the chamber is further reduced to a point wherein the pressure in the chamber is generally at, or less than, the vapor pressure of water at the selected temperature of the wood. The temperature sensing thermister or thermocouple 208 and switching device 206 interact to turn the blankets 100 on and off to maintain the temperature of the wood at the preselected temperature. The temperature sensor 208 and switch 206 function much like a household thermostet turning a furnace on and off to maintain a house at a preselected temperature.

The preselected temperature need not remain the same throughout the drying process. Applicant's have found that effective results are achievable by increasing the selected temperature of the wood during the course of the drying process. By increasing the temperature, the constancy of the drying rate of the wood is maintained.

For example, for a particular charge of wood 88, the pressure of the chamber 13 was first reduced to 65.8 mm Hg. This pressure corresponds to the pressure at which water will boil at 110° F. (43.3° C.), and is slightly above the pressure which is required to cause the water to boil at the selected temperature, 104° F. (40° C.), to which the wood was to be heated. The heating blanket 100 was activated to heat the wood to the selected temperature. When the average temperature of the wood reached the selected temperature (104° F.), the pressure within the chamber 13 was further reduced to approximately 36.1 mm Hg. This is the pressure at which water will boil at 90° F. (32.2° C.), and is less than the pressure (55.3 mm Hg) at which water will boil at 104° F. (40.0° C.). When the wood was dried to a point wherein the moisture content of the wood reached approximately 20%, the heating blankets 100 were turned up to raise the temperature of the wood from 104° F. (40° C.) to approximately 120° F. (48.9° C.). As more moisture was driven off, and hence the wood became drier, the heating blankets were turned up again to raise the temperature of the wood from 120° F. (48.9° C.) to 140° F. (60.0° C.).

One method for determining when to increase the temperature to which the wood is heated is to measure the flow of water from the chamber 13. It has been found by applicants that a decrease in the flow of moisture from the chamber 13 is indicative of less moisture being removed from the wood and, hence indicative of a decrease in the drying rate. To counteract this decrease, the selected temperatures to which the wood is heated is increased.

When the pressure of the chamber 13 is reduced below the pressure at which water will boil at the selected temperature, the liquid water throughout the thickness of any plank 93 begins to vaporize or attempts to vaporize and migrate outwardly from points of higher pressure to points of lower pressure. Generally, this results in water migrating from the interior of any given plank 93 toward its surface.

The temperature within the board tends to drop rapidly as the water absorbs energy during its vaporization. The temperature of the core of the planks tends to drop at a substantially quicker rate than the temperature of the surface of the plank 93. The core tends to cool more quickly because the heating blankets 100 at the planks' 93 surface impart vaporization energy to the water molecules at the surface. This process may be referred to as an "inverse cooling cycle." During this period of rapid moisture vaporization, the refrigeration system 27 is turned on, to actuate the evaporator coils 68. The evaporator coils 68 condense the moisture which is removed from the wood into liquid water, which is removed from the chamber 13 by vacuum pump 72 and deposited by outlet hose 74 into water tank 76.

During this period of the cycle, two distinct functions are in process. First, heat is being pumped into the wood charge 88 by means of heating blankets 100. This heat is absorbed by the water as it evaporates. The absorbed heat is then carried by the water outwardly from the wood charge 88 to the air conditioning evaporator coils 68 where the water vapor releases energy in its condensation from vaporous water to liquid water. The energy released by the water during the condensation process is removed from the chamber 13 by the refrigerant flowing through and out of the evaporator coils 68 into the condenser 66 and compressor (not shown).

Secondly, water which is in its liquid form within the planks 93 vaporizes and either migrates to the plank's surface, or causes pressure which forces vaporized water to move to the plank's surfaces. Water at the planks' surfaces migrates generally from the planks' surface to the evaporator coils 68 where it is condensed from vaporous water into liquid water. This vaporization, condensation, and energy transfer takes place within the chamber 13 and provides, in effect, a closed loop process which does not alter the reduced pressure in the chamber 13, providing that adequate condensing capacities are available from the refrigeration system 27.

By placing the condensing means 68 away from the charge of wood 88, the moisture from the condensed water is kept away from the wood.

Preferably, the evaporator coils 68 are placed out of thermal conductive contact with the charge of wood 88. The evaporator coils 68 need not be spatially separated by a large distance from the charge of wood 88 as the reduced pressure in the chamber 13 acts as an insulator between the evaporator coils 68 and the charge of wood 88, to help prevent the cool evaporator coils 68 from cooling the charge of wood 88.

The closed-loop effect described above allows the vacuum pump 72 to be turned off, or run only intermittently after the desired reduced pressure below the vapor pressure of water at the selected temperature is reached. The heat is controllably applied to the wood by the heating blankets 100, to vaporize water within the wood 88 until the vapor pressure gradient within the wood diminishes to a level which is ineffective for further removal of water vapor. When the vapor pressure gradient becomes ineffective, the air conditioning system 27, and hence evaporator coils 68, is turned off and the pressure inside the chamber 13 is allowed to increase above the vapor pressure of water at the selected temperature, but well below atmospheric pressure. For instance, in the example given above, wherein the vapor pressure was reduced during the majority of the drying cycle to 36.1 mm Hg (the pressure at which water will boil at 90° C.), the pressure in the chamber 13 during this portion of the cycle was allowed to rise to approximately 65.8 mm Hg, (the pressure at which water boils at 110° F. (43.3° C.)). This pressure is well below the standard atmospheric pressure of 760 mm Hg. When the temperature of the wood charge has again increased to a point above the vapor pressure of water at the selected boiling temperature, the vacuum system is actuated to again reduce the pressure in the chamber 13 to a pressure below the vapor pressure of water at the selected boiling temperature.

This point establishes the end of one complete cycle of the drying process. These cycles are continued repetitively as described above until the moisture content of the wood reaches a desired level, and the drying process is completed. For example, for some purposes, a moisture level of 25% of the wood fiber saturation point is suitable. Other purposes may require that the moisture content in the wood be reduced to between 6–8%. As the moisture content is reduced, the temperature of the wood is increased at a sufficient rate to maintain an internal vapor pressure gradient in the wood which will ensure a relatively constant drying rate.

At points in a drying cycle wherein the pressure of the chamber 13 is slightly above the vapor pressure of water at the selected temperature, some evaporation of water still takes place. It is observed that the water which boils at such pressures and temperatures tends to recondense almost immediately at the surface of the wood planks 93. It is known that the evaporation of water requires approximately 1,032 BTUs of energy per pound of water evaporated (573.33 calories per gram), and that the recondensation of the water vapor releases the same amount of energy. It is believed that the energy released during this process penetrates the wood and aids in the quick recovery of the internal temperatures of the wood which are necessary to reestablish a vapor pressure gradient in the wood sufficient to drive moisture from the wood. This phenomenon is believed to be utilized by the present invention in the following ways. (1) Quick heat recovery of the wood after the evaporative cooling cycle is an important element of the dramatically shortened kiln drying schedule of the invention. (2) Moisture provided by this phenomena at the surface of the wood provides additional conduction for the heat being applied to the wood charge 88 by the flexible heating blankets 100. (3) The recondensation process drives moisture vapor deep into the wood where it condenses, releasing bursts of high energy and, thereby providing a conductive vehicle for the heat being applied to the charge of wood 88 by the flexible heating blankets 100.

In this regard, it is noted that wood's insulative qualities make it more difficult to drive heat into the mass of wood as the wood becomes drier. During the portion of the process wherein water is evaporating at the surface of the wood planks 93, the center portion of the planks 93 tend to become cool before the surfaces of the planks 93. The cooling process progresses generally outwardly from the center portions of the planks 93 toward the surfaces of the wood planks 93, until the inside temperature and surface temperature of the planks 93 approach the vaporization temperature. At this point, evaporation at the surface of the planks 93 diminishes rapidly. The present invention utilizes the controlled application of heat at the wood surface during the drying process to encourage temperature equalization between the center and outer surfaces of the planks, in addition to the purpose of supplying required energy to the wood to foster the evaporation of water in the planks 93.

As discussed above, applicants have found that a correlation exists between the suction pressure on the compressor 220 and the dryness of the wood. When the wood has reached a point in the drying process wherein the moisture content is in the desired range, e.g., 6 to 8%, the suction pressure on the compressor 220 which is sensed by the compressor sensor 224 will fall off to a preselected point, such as 30 pounds pressure. When this point is reached, the controller 213 will send a signal to the main controller 203 to shut down the unit completely. At this point, the drying process is finished. The wood can then be be put through a conditioning process. Wood which is put through the conditioning process goes through the following steps. The controller 213 is again activated and the heating blanket 100 is turned on to apply additional heat to the wood, to heat the wood to a temperature higher than the temperature at which the wood was last heated. For example, if the wood throughout the final portion of the drying cycle was heated to 140° F., (60.0° C.) the wood in the conditioning process would be heated to 170° (76.6° C). When the wood reaches the temperature selected for the heating portion of the conditioning process, the heating blankets 100 are turned off.

The vacuum system 30 is then turned on to reduce the pressure within the kiln chamber 13 to a pressure as low as the vacuum pump is capable of pulling. During this time, the refrigeration system 27 and hence evaporator coils 68 remain shut off.

The combination of increased heat and reduced pressure permits a 100% relative humidity to be rapidly achieved inside the kiln chamber 13. When such a humidity level is reached, additional moisture which is being driven from the wood will recondense on the surface of the wood, wetting that surface, and thus causing the tension which has been built up in the wood through the drying process to be released. This causes the wood to become relaxed, counteracting much of the case hardening which has occurred in the wood. After approximately one hour the wood has finished its conditioning process. Kiln 10 can then be opened and the charge of wood 88 removed.

Although the invention has been described in detail with reference to certain preferred embodiments and specific process examples, variations and modifications exist within the scope and spirit of the invention as described and as defined in the following claims.

What is claimed is:

1. A process for accelerating the drying of a wood piece having an exterior surface comprising the steps of heating the wood piece in a chamber to a selected temperature, reducing the pressure in the chamber to a pressure at least as low as the vapor pressure of water at the selected temperature and further heating the wood piece by conduction with a flexible heating means which conformably engages the surface of the wood piece while maintaining a reduced pressure in the chamber, the heating means being sufficiently flexible for remaining in contact with the surface of the wood piece substantially throughout the drying process.

2. The process of claim 1 further comprising the step of condensing water vapor in the chamber into liquid water.

3. The process of claim 2 wherein the water vapor is condensed with a refrigeration system evaporator coil.

4. The process of claim 1 further comprising the step of reducing the pressure in the chamber to a subatmospheric pressure during the heating the wood piece.

5. The process of claim 1 wherein the temperature of the wood piece is maintained throughout the drying process at a temperature generally at least as high as the selected temperature.

6. A process for accelerating the drying of a wood piece having an exterior surface and an interior comprising the steps of heating the wood piece in a chamber to a selected temperature, reducing the pressure in the chamber while heating the wood piece by conduction with a flexible heating means which conformably engages the surface of the wood piece to establish a vapor pressure gradient in the wood piece sufficient to cause water vapor in the interior of the wood piece to move toward the exterior surface of the wood piece, the heating means being sufficiently flexible for remaining in contact with the surface of the wood piece substantially throughout the drying process.

7. The process of claim 6 further comprising the steps of condensing water vapor removed from the wood into liquid water with a condensing means.

8. The process of claim 7 further comprising the steps of maintaining the reduced pressure in the chamber until the vapor pressure gradient in the wood piece becomes generally ineffective to cause water vapor in the interior of the wood piece to move toward the exterior surface, deactuating the condensing means and permitting the pressure in the chamber to rise to a pressure above the vapor pressure of water at said selected temperature, controllably heating the wood piece during the deactuation of the condensing means and rise of the pressure in the chamber, and reducing the pressure in the chamber to again establish a vapor pressure gradient in the wood piece sufficient to cause water vapor in the interior of the wood piece to move toward the exterior surface.

9. A device for accelerating the drying of a wood piece having an exterior surface comprising a housing having a chamber into which the wood piece can be placed, a flexible heating blanket for heating the wood piece by conduction, and vacuum means for reducing pressure in the chamber, the flexible heating blanket being sufficiently flexible to conform to the exterior surface of the wood piece substantially throughout the drying of the wood piece.

10. The invention of claim 9 wherein the flexible heating blanket comprises first and second planar, electrically non-conductive, generally parallel sheet members and a resistively heatable element interposed between the sheet members.

11. The invention of claim 9 and further including at least two individually controllable heating blankets for heating at least two layers of wood pieces, at least two temperature sensing means, one temperature sensing means for sensing the temperature of each of the layers of wood pieces, and control means responsive to the temperature sensing means for controlling the heating blankets.

12. The invention of claim 10 and further including condensing means for condensing the removed water vapor into liquid water.

13. A kiln comprising a sealable container into which a charge of wood arranged in a plurality of vertically stacked layers of planks may be placed, means for heating the planks, said heating means including a plurality of thin flexible heating blankets disposed respectively between the layers of planks and conforming to the surfaces of the planks, means for pulling a vacuum within said container and means for condensing water vapor driven from the planks by the combined effect of heating them in a reduced atmosphere, said condensing means being disposed within said container.

14. The invention of claim 13 wherein the heating means comprises first and second generally parallel flexible sheet members and a flexible resistively heatable element interposed between the sheet members.

15. The invention of claim 13 wherein the heating means comprises first and second generally parallel flexible plastic sheet members and a flexible metal sheet member interposed between the plastic sheet members.

16. The invention of claim 15 further comprising a clamp means for clamping an edge of the plastic sheets and metal sheet together, the clamp being in electrically conductive contact with the metal sheet and including a terminal portion to which an electrical source can be coupled.

17. The invention of claim 13 wherein the container includes an interior wall and the condensing means comprises a refrigeration system evaporator coil.

18. A process for conditioning wood to reduce case hardening of the wood at the end of the drying process in a chamber comprising the steps of removing the majority of the moisture from the wood, heating the wood in the chamber at subatmospheric pressures to allow additional moisture to migrate from the wood core outwardly to the wood surface, promoting recondensation of moisture vapor at the wood surface, to wet the surface of the wood to release tension and case hardening of the wood surface.

19. A device for accelerating the drying of a plurality of layers of wood pieces, comprising a housing having a chamber into which the wood pieces can be placed, flexible heating blanket for heating the wood pieces, and vacuum means for reducing pressure in the chamber, the flexible heating blanket being sufficiently flexible to permit it to be disposed in serpentine relation about the layers of wood pieces.

20. The invention of claim 19 wherein the flexible heating blanket comprises first and second planar, electrically non-conductive, generally parallel sheet members and a resistively heatable element interposed between the sheet members.

21. The invention of claim 20 wherein the first and second generally flexible sheet members comprises electrically non-conductive plastic sheets having a thickness on the order of 0.005 inches (0.127 mm) and the flexible resistively heatable element comprises a metal foil sheet having a thickness on the order of 0.0009 inches (0.0229 mm).

* * * * *